US007322922B2

(12) United States Patent
Johansson et al.

(10) Patent No.: US 7,322,922 B2
(45) Date of Patent: Jan. 29, 2008

(54) METHOD AND DEVICE FOR JOINTING OF CORES

(75) Inventors: Kjell Johansson, Falkenberg (SE); Göran Ljungek, Holm (SE)

(73) Assignee: Core Link AB, Falkenberg (SE)

( * ) Notice: Subject to any disclaimer, the term of this patent is extended or adjusted under 35 U.S.C. 154(b) by 361 days.

(21) Appl. No.: 10/482,842

(22) PCT Filed: Jul. 2, 2002

(86) PCT No.: PCT/SE02/01319

§ 371 (c)(1),
(2), (4) Date: May 19, 2004

(87) PCT Pub. No.: WO03/004393

PCT Pub. Date: Jan. 16, 2003

(65) Prior Publication Data

US 2004/0188014 A1 Sep. 30, 2004

(30) Foreign Application Priority Data

Jul. 5, 2001 (SE) ..... 0102452

(51) Int. Cl.
*B31C 5/00* (2006.01)

(52) U.S. Cl. ..... 493/276; 493/286; 493/269; 493/270; 493/128; 493/150; 493/149; 156/304.2; 156/314

(58) Field of Classification Search ..... 493/128, 493/129, 136, 141, 140, 139, 150, 152, 276, 493/269, 286, 149; 156/158, 304.1, 304.2, 156/310, 314, 305
See application file for complete search history.

(56) References Cited

U.S. PATENT DOCUMENTS 3,037,900 A * 6/1962 Hings et al. ..... 156/310
3,289,552 A * 12/1966 Corazzo ..... 493/107
4,257,630 A * 3/1981 Bartell et al. ..... 285/21.2
4,746,384 A * 5/1988 Tan ..... 156/82
4,876,041 A * 10/1989 Hanselka ..... 264/571
5,221,387 A * 6/1993 Robbins et al. ..... 156/85
5,328,648 A * 7/1994 McBrien et al. ..... 264/35
5,385,260 A * 1/1995 Gatcomb ..... 229/400
5,505,368 A * 4/1996 Kanter et al. ..... 229/122.32
5,529,590 A * 6/1996 Ennis et al. ..... 51/298
5,790,762 A * 8/1998 Aepli et al. ..... 385/80
5,975,587 A * 11/1999 Wood et al. ..... 285/15
5,997,974 A * 12/1999 Schlueter et al. ..... 428/58
6,074,511 A * 6/2000 Takano et al. ..... 156/304.2

(Continued)

*Primary Examiner*—Christopher Harmon
(74) *Attorney, Agent, or Firm*—McGinn IP Law Group, PLLC

(57) ABSTRACT

End-to-end joining of sleeves. A first glue strand is applied to the end joint surface of one of the sleeves, the first glue strand having properties that cause an immediate fixing of the end joint surfaces of the sleeves. A second glue strand is applied to the end joint surface of one of the sleeves, the second glue strand having properties that causing wetting of the sleeve material in the joint surface and its immediate vicinity. The end joint surface of a first one of the sleeves is positioned against the end joint surface of a second one of the sleeves so that the first glue strand causes an immediate fixing of the end joint surfaces, and the second glue strand is allowed to set. The apparatus includes alignment devices for positioning the sleeves adjacent glue nozzles and for positioning the sleeves in end-to-end contact.

20 Claims, 7 Drawing Sheets

U.S. PATENT DOCUMENTS 6,145,895 A * 11/2000 Patel et al. ..... 285/369
6,228,204 B1 * 5/2001 Reinhardt et al. ..... 156/304.2
6,229,122 B1 * 5/2001 Assen ..... 219/544
6,309,413 B1 * 10/2001 Dereume et al. ..... 623/1.13
6,355,318 B1 * 3/2002 Tailor et al. ..... 428/34.9
6,494,493 B1 * 12/2002 Baruh ..... 285/31
6,627,036 B1 * 9/2003 Suendermann ..... 156/322
6,632,306 B1 * 10/2003 Roberts et al. ..... 156/95
6,706,133 B1 * 3/2004 Erkkila ..... 156/94
6,733,609 B2 * 5/2004 Leonarda van Heck .... 156/159

* cited by examiner

METHOD AND DEVICE FOR JOINTING OF CORES

FIELD OF THE INVENTION

The present invention relates to a method of joining cores, e.g., paperboard sleeves which in the paper industry are used to support rolls of paper. Further, the present invention relates to an apparatus for carrying the method into effect.

BACKGROUND OF THE INVENTION

Within, among others, the paper industry, there has become a steadily increasing need to be able to join sleeves of, above all, paperboard in order to be able to reuse sleeves which would otherwise be scrapped. However, extremely strict demands are placed on the quality of the joined sleeves. This relates in particular to the joint itself which must be strong (show considerable mechanical strength in all axes) and which must keep the sleeve sections aligned with one another and with correct roundness. The mechanical strength requirements are particularly large since a sleeve breakage can lead to serious accidents with both personal injuries and serious damage to machinery.

The task forming the basis of the present invention is to realise a novel method and a novel apparatus for joining sleeves of the type disclosed by way of introduction.

Through the present invention, there will be realised a method of joining sleeves, whereby the joints display extraordinary mechanical strength and great accuracy as regards alignment and roundness. The method according to the present invention also permits the realisation of a simple and reliable apparatus for carrying out the method. An apparatus according to the present invention permits a high degree of automation.

BRIEF DESCRIPTION OF THE DRAWING

The present invention will be described in greater detail hereinbelow with reference to the accompanying drawings.

DETAILED DESCRIPTION

Figure 1:
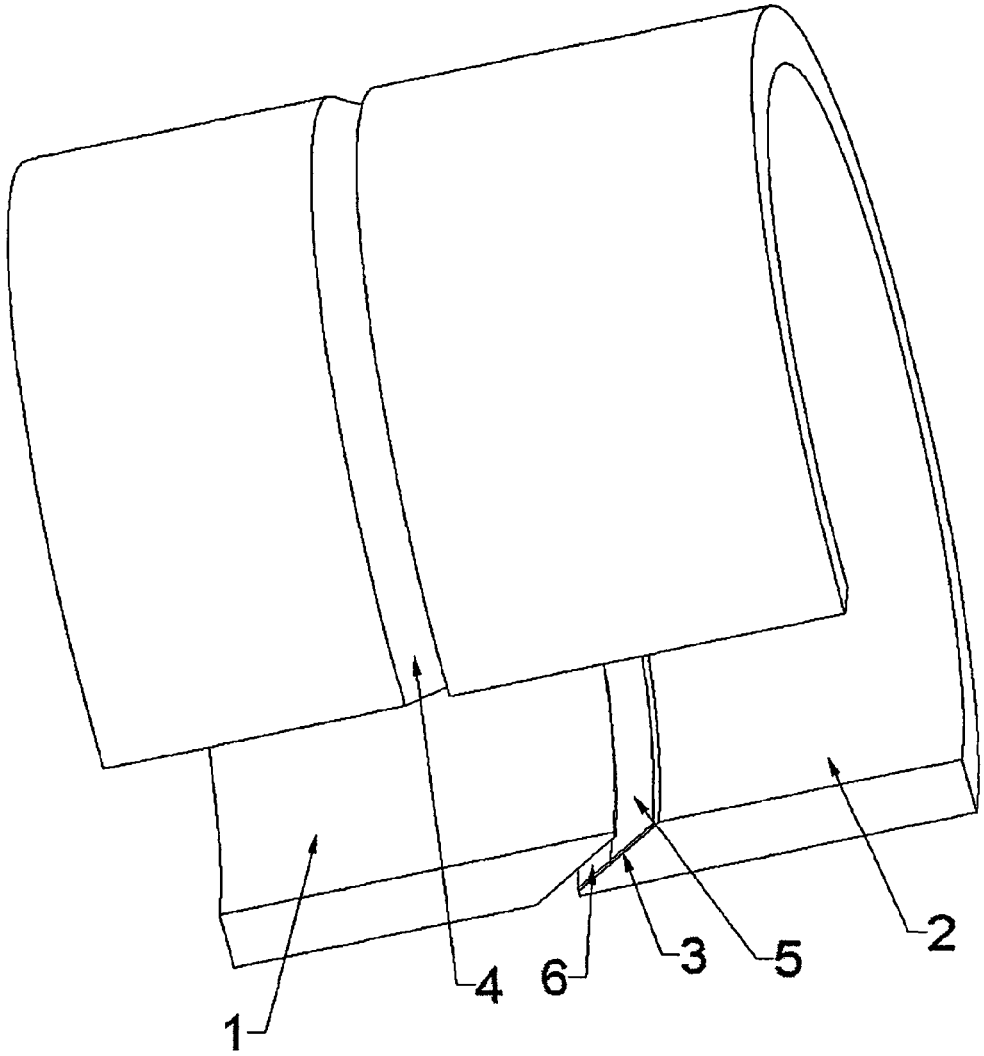
FIG. 1 shows a schematic view of a future joint between two sleeves, parts having been broken away for purposes of clarity.

In the different drawing figures, the same parts have been given the same reference numeral. In FIG. 1 parts are exemplified of two paperboard sleeves 1 and 2 which are to be joined together to one another. In this case, the sleeve 2 is provided with an inner conical surface 3, while the sleeve 1 is provided with an outer conical joint surface 4. On the conical joint surface 3 there is applied a first glue strand 5 and a second glue strand 6. The glue strand 5 may consist of a melt glue, while the glue strand 6 consists of a dispersion glue. It is also possible to cause the glue strand 5 to consist of a dispersion glue, while the glue strand 6 in such case consists of a melt glue.

For achieving a good joint quality, it has proved to be particularly important that the one glue strand consists of a glue of such properties that it gives an immediate fixing after closure of the joint in that the sleeves 1 and 2 are moved towards one another and exercising of a suitable compression pressure. One such glue is a melt glue. If the one glue strand, e.g. 5, consists of a melt glue, it is suitable that the other glue strand consist of a glue which has such properties that the glue wets the sleeve material and penetrates in between the fibres and sets, for example, by drying. Such properties possess a dispersion glue or PVA glue.

The primary duty of the melt glue strand is to fix the two sleeve parts 1 and 2 into a unit, which can be transported and after-processed by, for example, cleaning. The dispersion glue joint serves substantially to impart, after setting, the mechanical strength which is sought for use of the sleeve formed by the sleeve parts 1 and 2.

The glue strand 5, 6 need not necessarily be continuous but may be discontinuous. Further, the one glue strand may be discontinuous and the other continuous. In the case when both glue strands are discontinuous, it may be appropriate that the glue sections of the one glue strand cover the spaces between the glue sections in the other glue strand.

Figure 2:
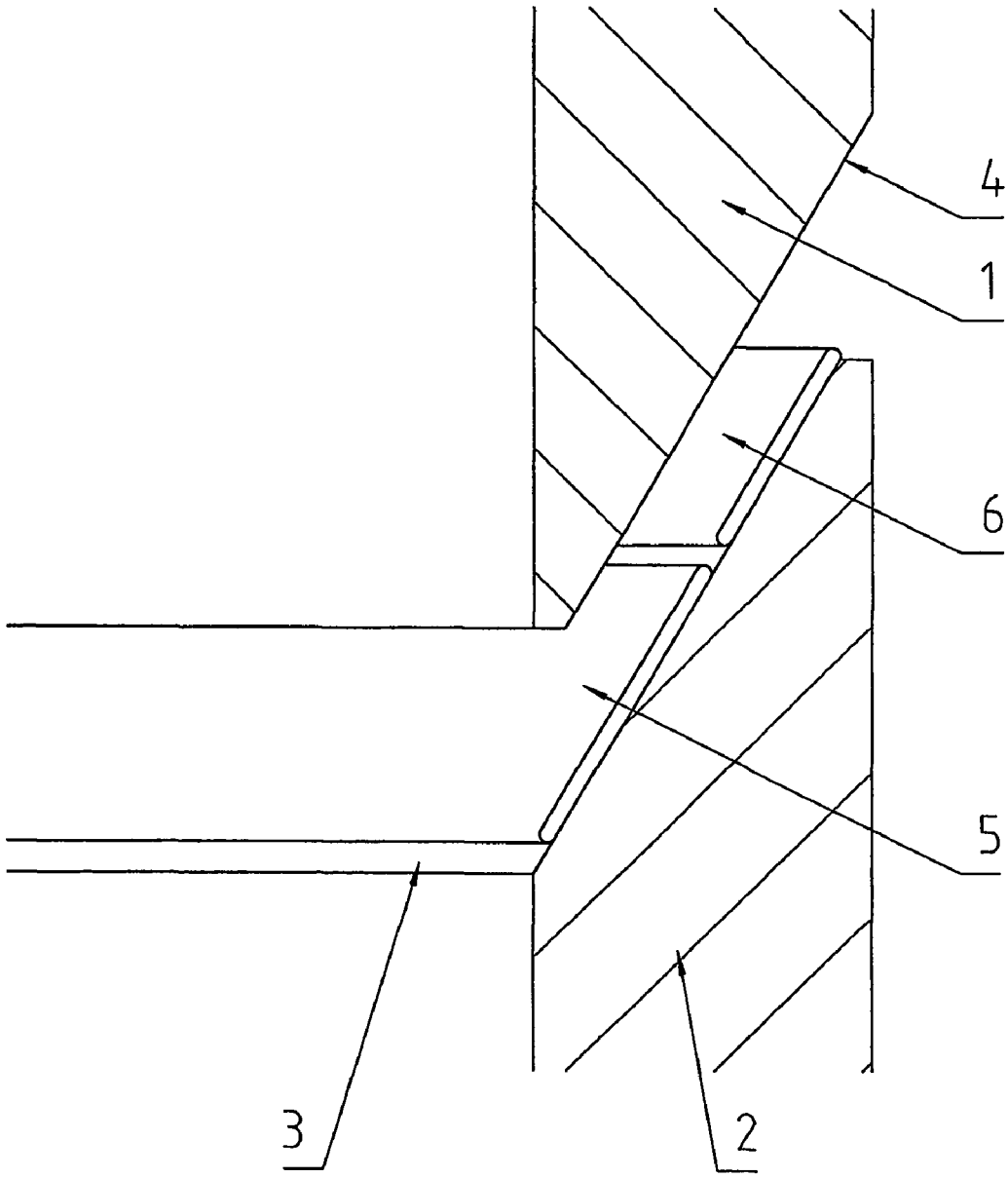
FIG. 2 shows on a large scale a view partly in section of a part of the future joint in FIG. 1.

FIG. 2 shows, on a large scale, a part of the glue joint of FIG. 1.

Figure 3:
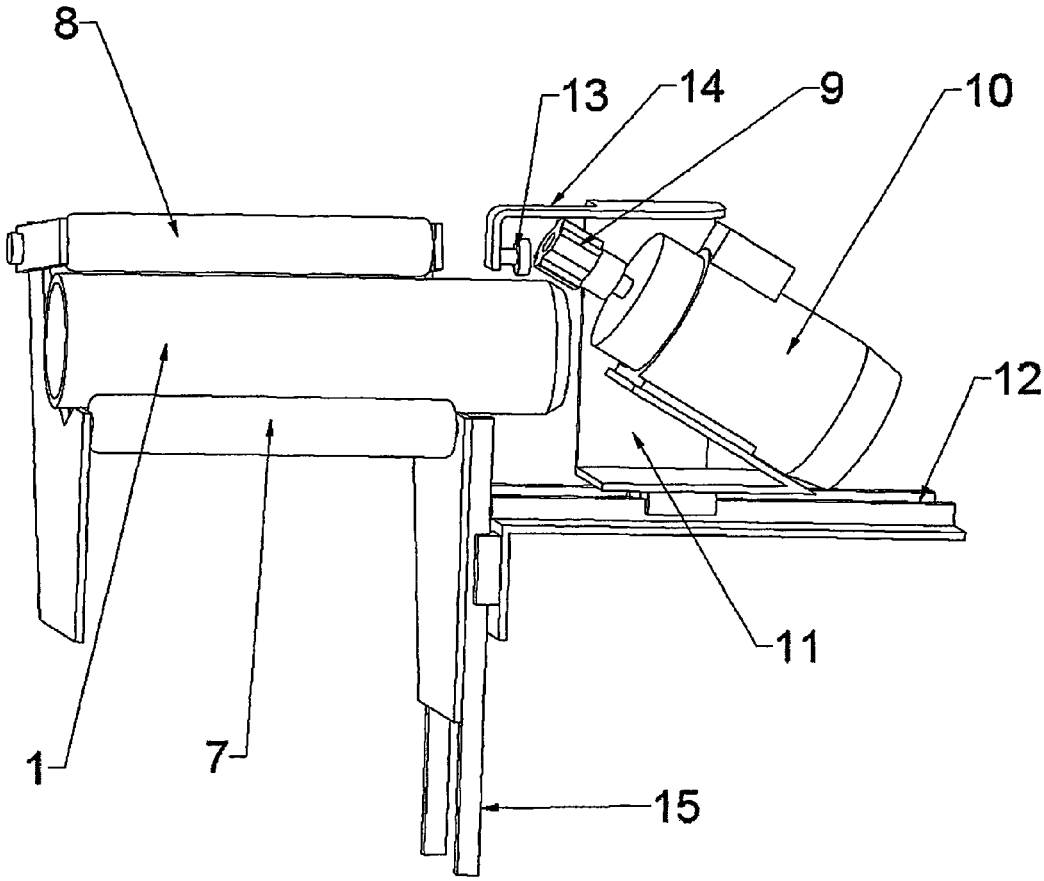
FIG. 3 shows a view of a part of an apparatus for realising the joint in FIG. 1 and 2.
Figure 4:
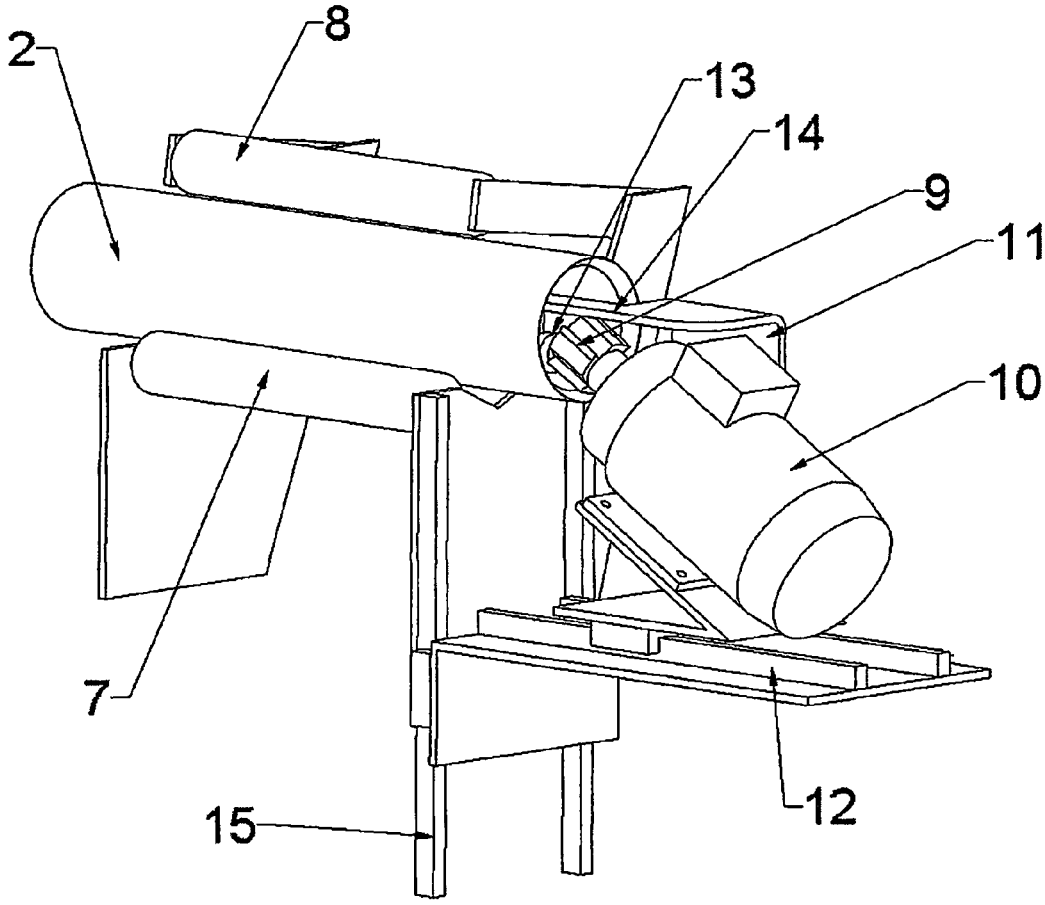
FIG. 4 shows a view of the apparatus in FIG. 3 under execution of another work phase.
Figure 5:
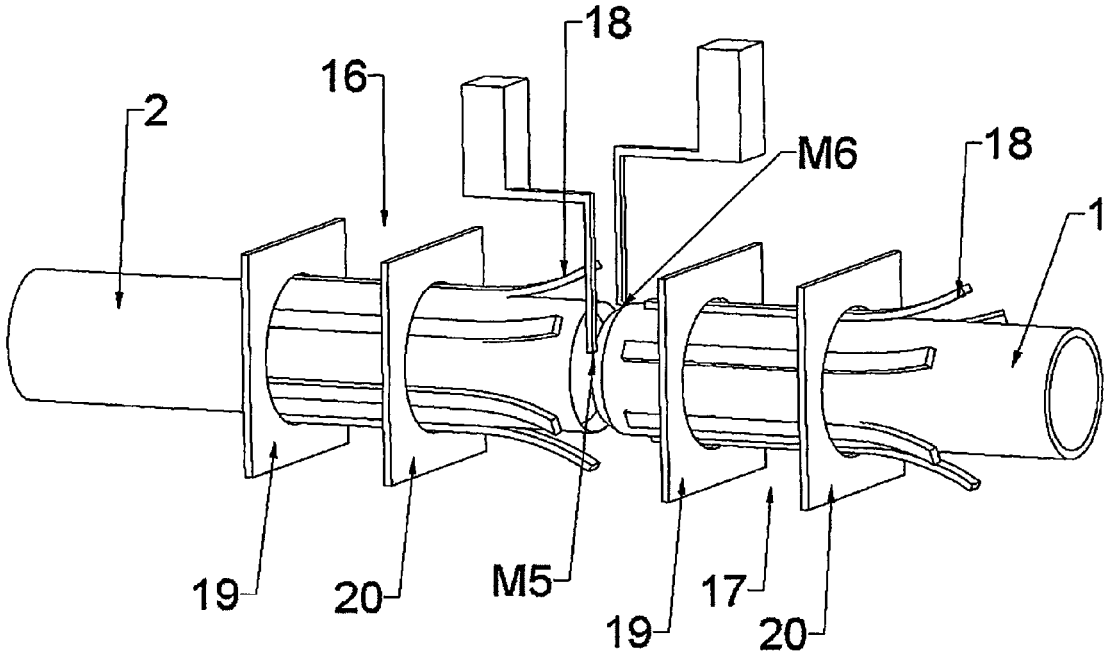
FIG. 5 shows a view of another part of an apparatus for realising the joint in FIG. 1 and 2.

In FIGS. 3, 4 and 5, are shown parts of an apparatus for realising a joint of the type illustrated in greater detail in FIGS. 1 and 2. FIG. 3 shows the sleeve section 1 placed on two rollers 7 which are placed side by side, only the one roller being apparent in the figure. Above the rollers 7 and the sleeve 1, there is disposed an additional roller 8 which serves to hold the sleeve 1 on the rollers 7 or to urge the sleeve 1 against the rollers 7. Possibly, the roller 8 may be utilised for rotation of the sleeve 1 on the rollers 7. It also conceivable to provide a separate drive means for rotation of the sleeve 1 in the roller package formed by the rollers 7 and 8.

At the end of the sleeve section 1, there is disposed a miller 9 which is driven by a motor 10 and which is placed at an angle to the sleeve 1 for processing the sleeve end edge in the desired angle for realising the joint surface 4 which is shown in FIGS. 1 and 2. The miller 9 and the motor 10 are disposed on a carriage 11 which is displaceable on a sliding rail 12 in the longitudinal direction of the sleeve 1. The carriage 11 supports a support roller 13 which is positioned on the end of an arm 14 which extends out from the carriage 11. The sliding rail 12 is displaceable at right angles to the sleeve 1 on a sliding rail 15 at right angles in relation to the sliding rail 12. The sliding rail 12 and the carriage 11 may be adjustable with the aid of a gear rack, thread spindle or the like.

FIG. 4 illustrates substantially the same apparatus as in FIG. 3, but with the parts in position for processing the sleeve section 2 and realising the joint surface 3, which implies that the inside of the sleeve section 2 is processed with the aid of the miller 9. Thus, the same apparatus may be employed for processing both the sleeve section 1 and the sleeve section 2 for creating, on the one hand, the female surface 3 and, on the other hand, the male surface 4.

After the processing of the sleeve sections 1 and 2 described in connection with FIGS. 3 and 4 for forming the joint surfaces 3 and 4, the sleeve sections 1 and 2 are to be aligned accurately with one another and this may be carried into effect with the aid of the alignment devices 16 and 17 shown in FIG. 5. As is apparent from FIG. 5, the alignment devices 16 and 17 are substantially identical and display a number of guide rails 18 which extend between two support walls 19 and 20, the guide rails 18 being outwardly bent at the one end in order to facilitate insertion of the sleeve sections 1 and 2. After the insertion of the sleeve sections 1 and 2 in the alignment devices 16 and 17, the alignment devices may be displaced to the position illustrated in FIG. 5 in which the longitudinal axes of the sleeve sections 1 and 2 are aligned with one another. This alignment of the alignment devices may naturally take place mechanically on some form of machine bed using rails or the like. At the joint formed between the sleeve sections 1 and 2 there is provided a nozzle M5 for application or coating of the glue strand 5 and a nozzle M6 for application of the glue strand 6. The nozzles M5 and M6 can be given a substantially optional positioning which is appropriate in the different individual cases. As was mentioned above, the one nozzle M5 serves for application of melt glue while the other nozzle M5 serves for application of a dispersion glue. The nozzles M5 and M6 are each connected to their glue container via a suitable valve (not shown) for regulating the supply of glue to the glue strands on the joint surface or joint surfaces.

After the application of the glue strands, the alignment devices are displaced towards one another, or the one sleeve section 1 is displaced into the other sleeve section 2 which, in such an event, is held fixed against axial movement. The compression pressure may be determined empirically and thereafter all joints can be pressed together with exactly the same compression pressure.

Figure 6:
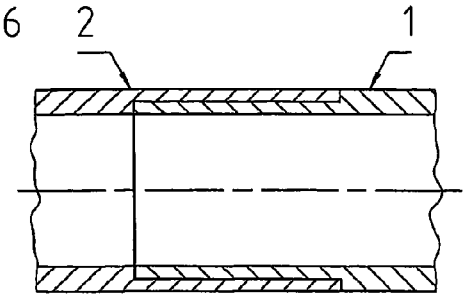
FIG. 6-12 show cross sections of different types of joints.
Figure 7:
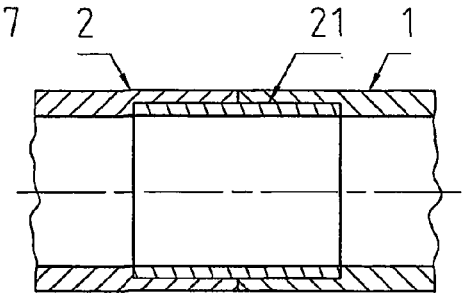
Figure 11:
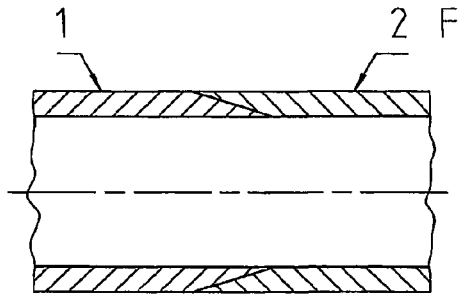
Figure 8:
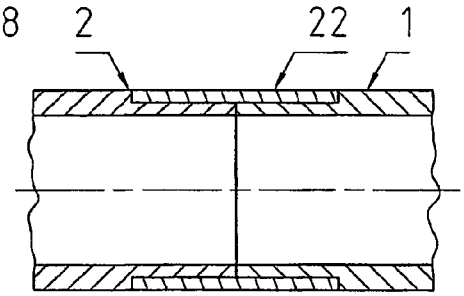
Figure 12:
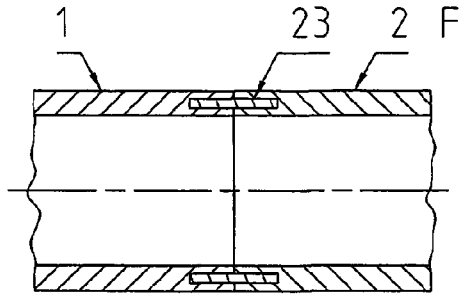
Figure 9:
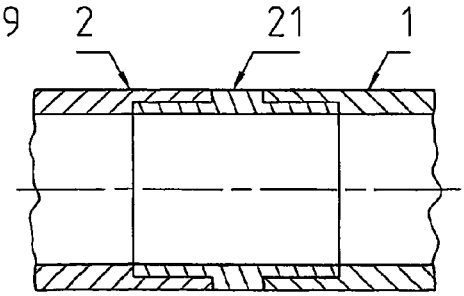
Figure 13:
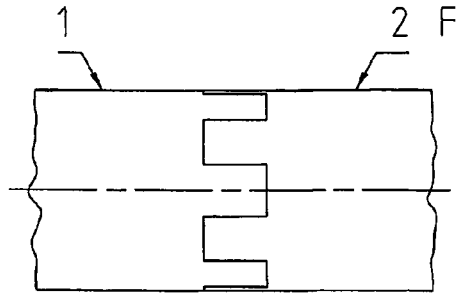
FIG. 13 shows a view of a joint.
Figure 10:
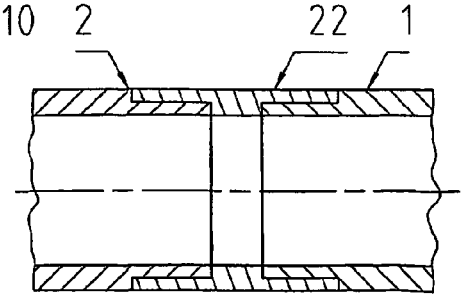

FIGS. 6-13 exemplify a number of joints. FIG. 6 shows a cylindrical male and female joint. In FIG. 7 is shown a joint with an insert 21. FIG. 8 shows a joint with a special outer portion 22. FIG. 9 shows a joint with a specially formed insert 21. FIG. 10 shows a joint with a specially formed outer portion 22. In FIG. 11 is shown a similar joint to FIGS. 1 and 2. FIG. 12 shows a special joint where the end surfaces of the sleeve sections 1 and 2 are straight or at right angles to the longitudinal axis of the sleeve sections 1, 2 and there a number of holes have been drilled axially in each sleeve section for the insertion of pins 23. FIG. 13 shows a further joint with toothed form. One advantage with the sleeve joints in FIGS. 7, 8, 9, 10, 12 and 13 is that the ends of the sleeve sections are processed in substantially the same way.

Figure 14:
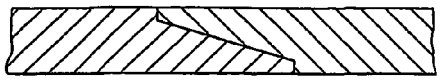
FIG. 14-30 show simplified cross sections of different types of joints.
Figure 15:
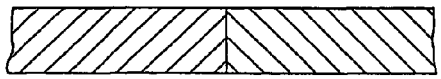
Figure 16:
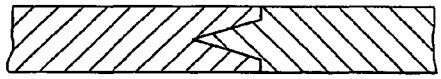
Figure 17:
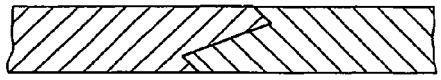
Figure 18:
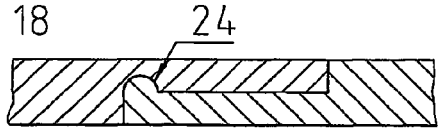
Figure 19:
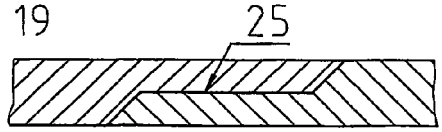
Figure 20:
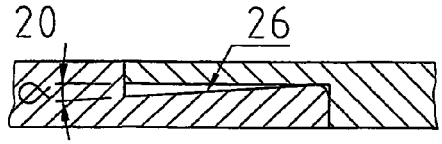
Figure 21:
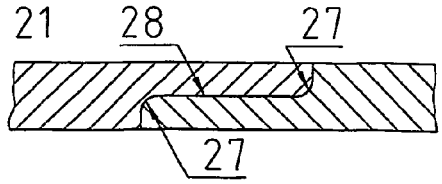
Figure 22:
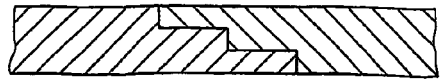
Figure 23:
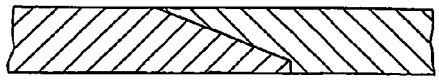
Figure 24:
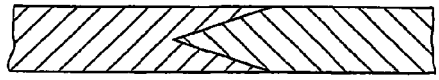
Figure 25:
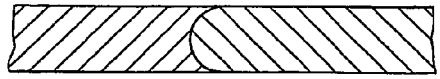
Figure 26:
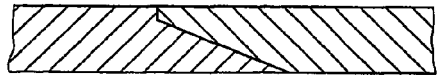
Figure 27:
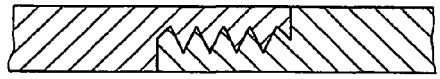
Figure 28:
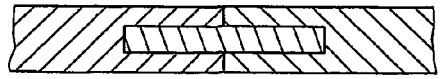
Figure 29:
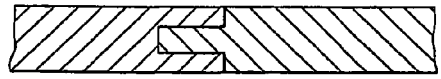
Figure 30:
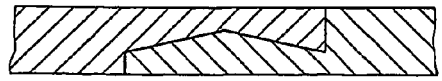

FIGS. 14-30 exemplify a further additional number of joint forms. FIG. 14 shows a conical joint with an outer and an inner planar support surface. FIG. 15 shows only a straight joint. FIG. 16 shows an arrowhead joint with a support surface. FIG. 17 shows a Z joint. FIG. 18 shows a joint with a bead 24. FIG. 19 shows a joint with a planar portion between oblique surfaces 25. FIG. 20 shows a joint with an angled portion 26 which makes an angle with the longitudinal axis of the sleeve sections. FIG. 21 shows a joint with rounded-off ends and planar central portion. FIG. 22 shows an echelon joint. FIG. 23 shows a conical joint with inner support surface. FIG. 24 shows a tipped joint. FIG. 25 shows a rounded-off joint. FIG. 26 shows a conical joint with outer support surface corresponding to the joint in FIG. 23. FIG. 27 shows a toothed/or threaded joint. FIG. 28 shows a plug joint. FIG. 29 shows a tongued and grooved joint. FIG. 30 shows a joint with gable top surfaces.

It is also possible to place the one glue strand 5 on the one joint surface 3 and the other glue strand 6 on the other joint surface 4. It is further possible to make many other combinations and distributions of the glue strands 5 and 6 on the joint surfaces 3 and 4. In the apparatus illustrated in FIG. 5, the rails 18 may be replaced by or combined with wheels and/or rollers.

Many modifications are naturally possible without departing from the inventive concept as defined in the appended claims.

The invention claimed is:

1. A method of end-to-end joining of two cylindrical sleeves, each cylindrical sleeve having an outer cylindrical surface and an inner cylindrical surface and including an end joint surface on the end of such cylindrical sleeve, said method comprising:

applying a strand of a first glue to at least a part of the width of the end joint surface of one of the cylindrical sleeves, the first glue having properties that cause fixing of the end joint surfaces of the sleeves within a first time period; and applying a strand of a second glue to at least a part of the width of the end joint surface of one of the cylindrical sleeves, the second glue having properties that causing wetting of the sleeve material in the joint surface and its immediate vicinity;

positioning the width of the end joint surface of a first one of the cylindrical sleeves against the width of the end joint surface of a second one of the cylindrical sleeves so that the first glue strand by itself causes fixing of the end joint surfaces within the first time period; and allowing the second glue strand to set by itself within a second time period, longer than the first time period.

2. A method according to claim 1, wherein the first glue comprises a melt glue.

3. A method according to claim 1, wherein the second glue comprises a dispersion glue.

4. A method according to claim 1 wherein one of the first glue strand and the second glue strand is applied discontinuously.

5. A method according to claim 4, wherein the first glue strand is placed discontinuously, with spaces between sections of the first glue strand, and the second glue strand is applied discontinuously, with sections of the second glue strand displaced in relation to the sections of the first glue strand.

6. A method according to claim 5, wherein the two glue strands are applied offset in relation to each other so that the sections of the first glue strand are within spaces between the sections of the second glue strand.

7. A method according to claim 1, wherein the first glue strand and the second glue strand are applied to the end joint surface of the same cylindrical sleeve.

8. A method according to claim 7, wherein the first glue strand is applied adjacent the outer cylindrical surface of the cylindrical sleeve, and the second glue strand is applied adjacent the inner cylindrical surface of the cylindrical sleeve.

9. A method according to claim 8, wherein one of the first glue strand and the second glue strand is applied discontinuously.

10. A method according to claim 7, wherein the first glue strand and the second glue strand are applied discontinuously.

11. A method according to claim 10, wherein the second glue strand is applied in the discontinuities of the first glue strand.

12. A method according to claim 1, wherein the first glue strand is applied to the end joint surface of a first one of the cylindrical sleeves, and the second glue strand is applied to the end joint surface of a second one of the cylindrical sleeves.

13. A method according to claim 12, wherein the first glue strand and the second glue strand are applied discontinuously.

14. A method according to claim 1, further comprising:

processing the end joint surface of a first one of the cylindrical sleeves to a first desired configuration; and processing the end joint surface of a second one of the cylindrical sleeves to a second desired configuration, wherein the first desired configuration and the second desired configuration permit the end joint surface of the first cylindrical sleeve and the end joint surface of the second cylindrical sleeve to be joined to provide a secure joining of the first and second cylindrical sleeves.

15. An apparatus for end-to-end joining of two cylindrical sleeves, each cylindrical sleeve including an end joint surface on the end of such cylindrical sleeve, said apparatus comprising:

a first glue nozzle for providing a strand of a first glue;

a second glue nozzle for providing a strand of a second glue;

a first alignment device for positioning a first one of the cylindrical sleeves; and a second alignment device for positioning a second one of the cylindrical sleeves, wherein:

the alignment devices position one of the cylindrical sleeves adjacent said first glue nozzle, permitting said first glue nozzle to apply the first glue strand on at least a part of the width of the end joint surface of that cylindrical sleeve, and position one of the cylindrical sleeves adjacent said second glue nozzle, permitting said second glue nozzle to apply the second glue strand on at least a part of the width of the end joint surface of that cylindrical sleeve, the alignment devices position the cylindrical sleeves with the width of the end joint surface of a first one of the cylindrical sleeves against the width of the end joint surface of a second one of the cylindrical sleeves, the first glue has properties that cause the first glue strand by itself to fix the end joint surfaces of the cylindrical sleeves within a first time period, the second glue has properties that cause wetting of the sleeve material in the end joint surface and its immediate vicinity and setting of the second glue strand by itself within a second time period, longer than the first time period.

16. An apparatus according to claim 15, wherein said alignment devices position the first one of the cylindrical sleeves adjacent both said first glue nozzle and said second glue nozzle.

17. An apparatus according to claim 15, wherein said alignment devices position the first one of the cylindrical sleeves adjacent said first glue nozzle and position the second one of the cylindrical sleeves adjacent said second glue nozzle.

18. An apparatus according to claim 15, further comprising:

a processing unit for processing the end joint surfaces of the cylindrical sleeves to configurations permitting the end joint surfaces of the cylindrical sleeves to be securely joined.

19. Apparatus according to claim 18, wherein said processing unit comprises a plurality of rails and a milling device for configuring the end joint surfaces of the cylindrical sleeves.

20. Apparatus according to claim 19, wherein, when one of the cylindrical sleeves in positioned on said milling device, said rails extend in the longitudinal direction of such cylindrical sleeve and are spaced around the circumference of such cylindrical sleeve.

* * * * *